US012655708B2

(12) United States Patent
Boulanger et al.

(10) Patent No.: US 12,655,708 B2
(45) Date of Patent: Jun. 16, 2026

(54) ELECTRIC ANNULAR WITH INTERNAL MOTOR

(71) Applicant: SCHLUMBERGER TECHNOLOGY CORPORATION, Sugar Land, TX (US)

(72) Inventors: Bruce Boulanger, Katy, TX (US); Gerrit Kroesen, Katy, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 19/121,436

(22) PCT Filed: Oct. 12, 2023

(86) PCT No.: PCT/US2023/035008

§ 371 (c)(1),
(2) Date: Apr. 16, 2025

(87) PCT Pub. No.: WO2024/086052

PCT Pub. Date: Apr. 25, 2024

(65) Prior Publication Data

US 2026/0139563 A1 May 21, 2026

Related U.S. Application Data

(60) Provisional application No. 63/380,245, filed on Oct. 20, 2022.

(51) Int. Cl.
*E21B 33/06* (2006.01)

(52) U.S. Cl.
CPC ..... *E21B 33/06* (2013.01)

(58) Field of Classification Search
CPC ..... E21B 33/06; E21B 34/02; E21B 33/085; H01K 7/10–1016
See application file for complete search history.

(56) References Cited

U.S. PATENT DOCUMENTS 2,368,332 A * 1/1945 Shaffer ..... E21B 33/06 277/327
4,458,876 A 7/1984 Schaeper
(Continued)

FOREIGN PATENT DOCUMENTS

| | | | |
|---|---|---|---|
| CN | 217003093 | U | 7/2022 |
| WO | 2024073352 | A1 | 4/2024 |
| WO | 2024086053 | A1 | 4/2024 |

*Primary Examiner* — Kenneth L Thompson
(74) *Attorney, Agent, or Firm* — Jeffrey D. Frantz

(57) ABSTRACT

Embodiments described herein provide a well valve assembly, comprising a housing having an axial passage for flowing well fluid through the tool; a component disposed within the housing around the axial passage, the component having a circular circumference and an outer wall with a circumferential thread on the outer wall; a gate assembly disposed within the housing and configured to open and close with axial movement of the component; a rotor disposed within the housing and having a structure for engaging with the circumferential thread on the outer wall to provide axial force on the component when the rotor rotates; a stator coupled to the rotor to rotate the rotor upon application of electric power; and a power conduit coupled to the stator to apply electric power to rotate the rotor.

15 Claims, 2 Drawing Sheets

(56) References Cited

U.S. PATENT DOCUMENTS

| | | | | |
|---|---|---|---|---|
| 7,025,322 | B2 | 4/2006 | Biester | |
| 7,798,466 | B2 | 9/2010 | Springett | |
| 8,776,892 | B2 | 7/2014 | Fern | |
| 9,627,940 | B2 | 4/2017 | Eriksen | |
| 10,415,339 | B2 | 9/2019 | Garro | |
| 10,487,587 | B2 | 11/2019 | Cummins | |
| 10,648,268 | B2 | 5/2020 | Jaffrey | |
| 10,689,933 | B2 | 6/2020 | Deul | |
| 11,066,892 | B2 | 7/2021 | Gallagher | |
| 11,414,950 | B2 * | 8/2022 | Gallagher | F16K 3/03 |
| 11,867,202 | B2 * | 1/2024 | Eriksen | F04D 13/0653 |
| 11,952,856 | B2 | 4/2024 | Katanguri | |
| 12,034,351 | B2 * | 7/2024 | Eriksen | H02K 7/06 |
| 12,060,776 | B2 * | 8/2024 | Pearce | E21B 41/00 |
| 12,146,377 | B1 | 11/2024 | Boulanger | |
| 12,152,459 | B1 | 11/2024 | Kroesen | |
| 2020/0217166 | A1 | 7/2020 | Arteaga | |
| 2021/0381332 | A1 | 12/2021 | Dhamodaran | |
| 2024/0401428 | A1 | 12/2024 | Katanguri | |

* cited by examiner

ELECTRIC ANNULAR WITH INTERNAL MOTOR

CROSS-REFERENCE TO RELATED APPLICATION

The present document is a National Stage Entry of International Application No. PCT/US2023/035008, filed Oct. 12, 2023, which claims the benefit of and priority to U.S. Provisional Patent Application No. 63/380,245, filed Oct. 20, 2022, which is incorporated herein by reference in its entirety.

FIELD

This patent application relates to equipment for hydrocarbon prospecting and production. Specifically, tools for controlling pressure during drilling operations are disclosed with components that are moved in an axial direction by an internal electric motor.

BACKGROUND

Oil and gas drilling equipment often uses equipment with components that must be moved in an axial direction of the drill string or well. One such tool is a blowout preventer, which is a valve assembly for restricting or stopping flow of fluid from a hydrocarbon well by remote operation. The valve assembly has an actuator that is usually manipulated using hydraulic thrusters, which are large and expensive. Smaller, more cost effective means of operating tools such as blowout preventers is needed.

SUMMARY

Embodiments described herein provide a well valve assembly, comprising a housing having an axial passage for flowing well fluid through the tool; a component disposed within the housing around the axial passage, the component having a circular circumference and an outer wall with a circumferential thread on the outer wall; a gate assembly disposed within the housing and configured to open and close with axial movement of the component; a rotor disposed within the housing and having a structure for engaging with the circumferential thread on the outer wall to provide axial force on the component when the rotor rotates; a stator coupled to the rotor to rotate the rotor upon application of electric power; and a power conduit coupled to the stator to apply electric power to rotate the rotor.

Other embodiments described herein provide a well valve assembly, comprising a housing having an axial passage for flowing well fluid through the tool; a component disposed within the housing around the axial passage, the component having a circular circumference and an outer wall with a circumferential thread on the outer wall of the component; a gate assembly disposed within the housing and configured to open and close with axial movement of the component; a rotor disposed within the housing and having a structure for applying axial force to the component when the rotor rotates; a stator disposed within the housing and coupled to the rotor to rotate the rotor upon application of electric power; an advancing screw structure disposed between the rotor and the component to transmit axial force between the rotor and the component; and a power conduit coupled to the stator to apply electric power to rotate the rotor.

Other embodiments described herein provide a well valve assembly, comprising a housing having an axial passage for flowing well fluid through the tool and an inner wall and an outer wall defining an annular receptacle around the axial passage within the housing; a component disposed within the annular receptacle, the component having a circular circumference and an outer wall with a circumferential thread on the outer wall of the component; a gate assembly disposed within the annular receptacle and configured to open and close with axial movement of the component; a rotor disposed within the annular receptacle and having a structure for applying axial force to the component when the rotor rotates; and a stator disposed within the annular receptacle and coupled to the rotor to rotate the rotor upon application of electric power.

DETAILED DESCRIPTION

Figure 1:
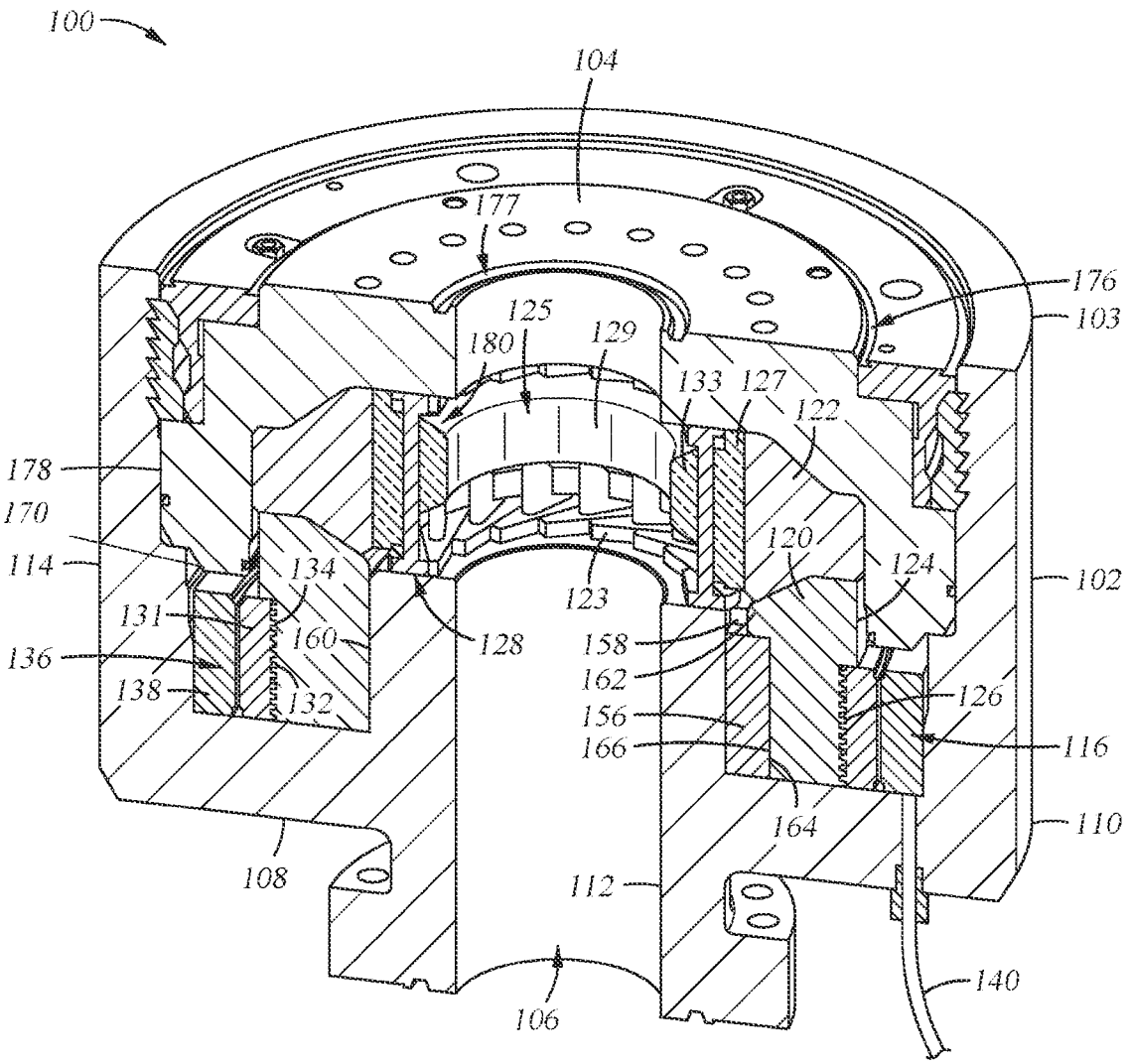
FIG. 1 is a partial cutaway view of an electrically-actuated well valve assembly according to one embodiment.

The well valve assemblies described herein use electric drive mechanisms, rather than hydraulic mechanisms, to open and close. As mentioned above, such valve assemblies can be used in blowout preventers for hydrocarbon wells. FIG. 1 is a partial cutaway view of an electrically-actuated well valve assembly 100 according to one embodiment. The well valve assembly 100 comprises a housing 102 and an end closure cap 104 to confine the operative components of the well valve assembly 100. The housing 102 is a cylindrical body, and the cap 104 generally attaches to, or at, a first end 103 of the housing 102. The housing 102 has an inner cylindrical axial passage 106 to permit fluid flow through the valve assembly 100. The housing 102 has an end wall 108 at a second end 110 of the housing 102 opposite from the first end 103. Extending from the end wall 108 is an inner wall 112, which defines the inner cylindrical passage 106, and an outer wall 114, both extending in an axial direction of the valve assembly 100, and together defining therebetween an annular receptacle 116 bounded by the inner wall 112, the outer wall 114, the end wall 108, and the cap 104.

A pushing member 120 is a component disposed in the annular receptacle 116. The pushing member 120 is a ring, or a ring-like body, that can move in an axial direction within the receptacle 116. The pushing member 120 may be a piston. A seal member 122 is disposed between an end of the pushing member 120 and the cap 104 so that movement of the pushing member 120 compresses the seal member 122 between the end of the pushing member 120 and the cap 104. A packing assembly 125 is disposed within the housing 102 between an interior end of the passage 106, within the housing 102, and the cap 104. The packing assembly 125 has an outer wall member 127 that is cylindrical in shape and has an inner surface 129 with a plurality of captures 133, each capture 133 receiving an iris member 123, such that each iris member 123 is partially embedded in the inner surface 129 of the outer wall member 127. The outer wall member 127 is made of a flexible, resilient material, such as an elastomeric material, and is configured, with the iris members 123, to be compressible so that radial compression of the compressible outer wall member 127 moves the iris members 123 radially inward to form an axial flow barrier, and so that relaxation of the radial compression on the outer wall member 127 allows the outer wall member 127 to expand, moving the iris members 123 radially outward to open the passage 106 for fluid flow.

The seal member 122 is disposed in contact with the cap 104 in an axial direction and also in an outward radial direction such that an outer radial surface of the seal member 122 is in contact with an inner radial wall of the cap 104. The cap 104 has a disk-like portion 176 and an annular portion 178 that extends from a periphery of the disk-like portion 176. The annular portion 178 defines a recess 180 of the cap 104. The disk-like portion 176 has an opening 177 that registers with the passage 106 to provide fluid flow through the cap 104.

The seal member 122 is disposed between an end of the pushing member 120 and the cap 104, in the axial direction of the assembly 100, so that axial movement of the pushing member 120 compresses the seal member 122 between the end of the pushing member 120 and the cap 104. The seal member 122 is also in contact with the outer wall member 127 of the packing assembly 125 in an inward radial direction. Movement of the pushing member 120 toward the cap 104 thus squeezes the seal member 122 between the pushing member 120 and the cap 104 in the axial direction, and between the cap 104 and the outer wall member 127 of the packing assembly 125 in the radial direction. Because the only freedom of movement is toward the inward radial direction, movement of the pushing member 120 causes the seal member 122 to deform in the inward radial direction. The seal member 122 thus compresses the outer wall member 127 radially inward, moving the iris members 123 radially inward to obstruct the passage 106 and stop fluid flow through the valve assembly 100.

The packing assembly 125 and seal member 122 define a gate assembly 128 for the valve assembly 100 that is operated by movement of the pushing member 120 in the axial direction. Movement of the pushing member 120 toward the cap 104 causes the gate assembly 128 to close, and movement of the pushing member 120 away from the cap 104 causes the gate assembly 128 to open. The gate assembly 128 is disposed between the pushing member 120 and the cap 104 and is received within the recess 180 of the cap 104. The annular portion 178 of the cap 104 extends around the seal member 122 of the gate assembly 128 to provide support for the gate assembly 128. The disk-like portion 176 of the cap 104 contacts the seal member 122 at one or more surfaces transverse and/or perpendicular to the axial direction of the well valve assembly 100. The annular portion 178 of the cap contacts the seal member 122 at an outer radius of the seal member 122.

The pushing member 120 has an outer surface 124, at least a portion of which is provided with an outer circumferential thread 126 formed in the outer surface 124. The outer circumferential thread 126 is configured to provide axial engagement force to the pushing member 120 from a threaded actuator engaged with the outer circumferential thread 126. The threaded actuator is a body having one or more threads that engage with the outer circumferential thread 126, and that is rotated by an electric motor disposed within the valve assembly 100, in the annular receptacle 116 of the housing 102.

In FIG. 1, the threaded actuator is a rotor 131. The rotor 131, in this case a ring actuator, extends circumferentially around the pushing member 120, and has an inner circumferential thread 132 at an inner surface 134 thereof, to engage with the outer circumferential thread 126 of the pushing member 120. The rotor 131 is a component of an electric motor assembly 136 disposed within the annular receptacle 116 of the valve assembly 100. A stator 138 is disposed around the rotor 131 to provide rotational force to the rotor 131 upon application of electric power. The stator 138, in this case, is also a continuous ring, or ring-shaped, and extends around the circumference of the rotor 131. In other cases, the stator 138 could be discontinuous, for example a ring with a gap, or may comprise discrete electromagnetic components disposed around the circumference of the rotor 131. The stator 138, rotor 131, or both have magnetic members (not shown), such as permanent magnets or electromagnets, to generate a magnetic field, and conductors to experience inductive force upon application of electric current. The magnetic members and electrical conductors are disposed within the stator 138, the rotor 131, or both to generate rotational force on the rotor upon application of electric power. A power conduit 140 is disposed through the housing 102 and coupled to the stator 138 to apply electric power to rotate the rotor 131.

The annular portion 178 of the cap 104 extends around the junction between the pushing member 120 and the seal member 122, extending around an upper portion of the pushing member 120, between the pushing member 120 and the housing 102. A distal end 170 of the annular portion 178 of the cap 104 extends to a location proximate to, or in contact with, an upper surface of the rotor 131 and an upper surface of the stator 138. The annular portion 178 of the cap 104 thus functions to restrain axial movement of the rotor 131 and the stator 138.

In operation, application of electric power to the stator 138 causes inductive force to be applied to the rotor 131, causing the rotor 131 to rotate. The threaded engagement of the rotor 131 with the outer circumferential thread 126 of the pushing member 120 exerts an axial force on the pushing member 120, causing the pushing member 120 to move in the axial direction. One or more guide members 156 are provided, each disposed in a slot 158 formed in an outer surface 160 of the inner wall 112 (facing the annular receptacle 116) at the outer radius thereof and extending in the axial direction, to guide motion of the pushing member 120. The guide members 156 are disposed between the pushing member 120 and the outer surface 160 of the inner wall 112, resting on an interior surface of the end wall 108, and function to constrain motion of the pushing member 120 in the axial direction and prevent unwanted lateral motion or rotation of the pushing member 120 in a radial direction. The pushing member 120 has at least one inner radial extension 162 that extends inward from an inner wall 164 of the pushing member 120 at the end of the pushing member 120 that engages with the seal member 122. The inner radial extension 162 can contact an end of a corresponding guide member 156 such that the guide member 156 constrains motion of the pushing member 120 in the axial direction. The inner wall 164 is in sliding contact with an outward facing surface 166 of the guide member 156 to constrain motion of the pushing member 120 in the radial direction.

As described above, when the pushing member 120 is moved axially toward the cap 104, the seal member 122 is deformed radially inward, compressing the outer wall member 127 of the packing assembly 125 and moving the iris members 123 radially inward, closing the gate assembly and stopping fluid flow through the valve assembly 100. When the pushing member 120 is moved axially away from the cap 104, by reverse operation of the electric motor assembly 136, deformation of the seal member 122 relaxes, decompressing the outer wall member 127 and moving the iris members 123 radially outward, opening the gate assembly and opening the passage 106 for fluid flow through the valve assembly 100 and the opening 177 of the cap 104.

Figure 2:
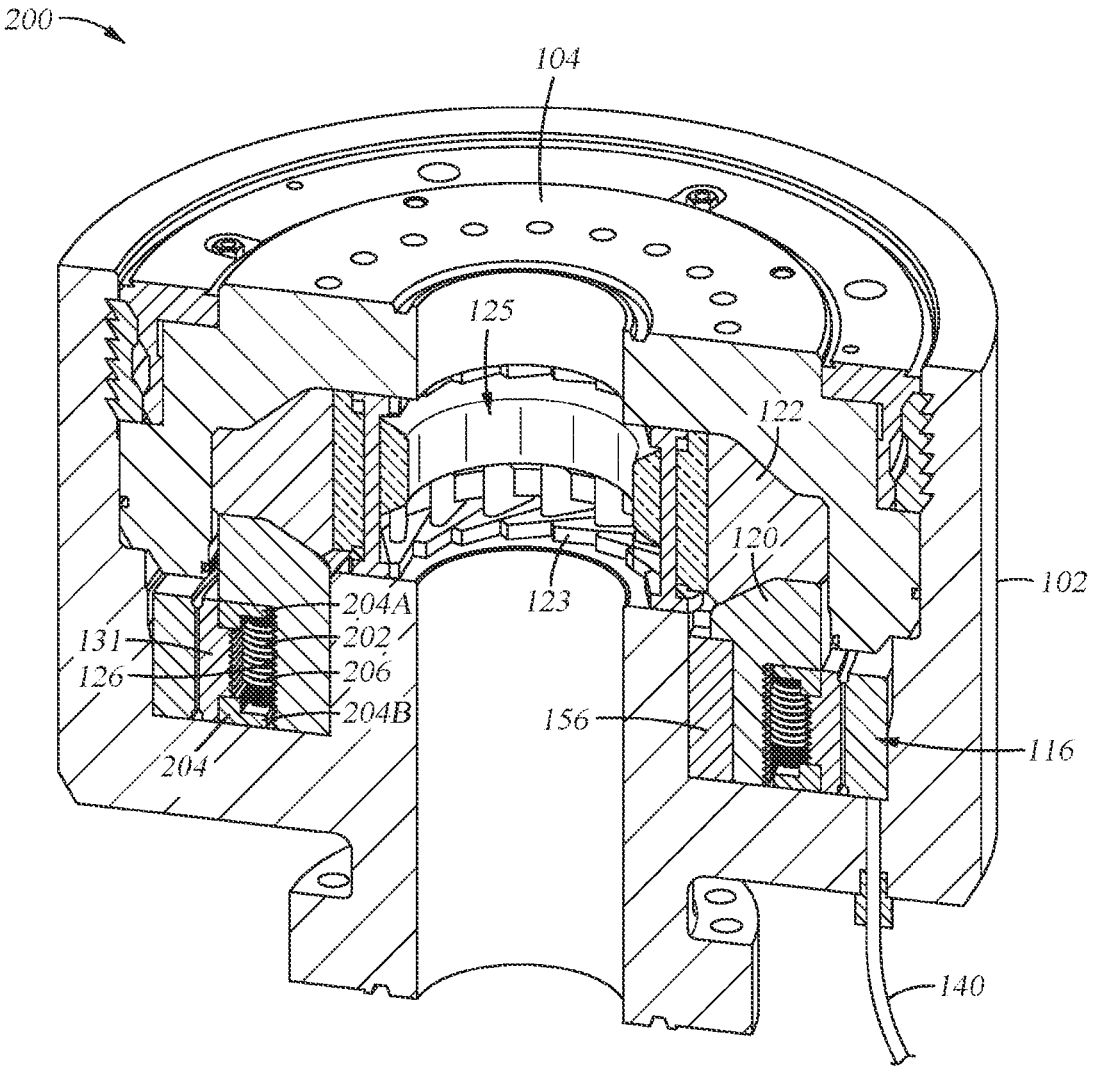
FIG. 2 is a partial elevation of an electrically-actuated well valve assembly according to another embodiment.

FIG. 2 is a partial elevation of an electrically-actuated well valve assembly 200, according to another embodiment. The valve assembly 200 uses the same housing 102, cap 104, pushing member 120, one or more guide members 156, seal member 122, and packing assembly 125. The valve assembly 200 uses a plurality of cylindrical planetary rollers 202 disposed between the rotor 131 and the pushing member 120. The planetary rollers 202 are attached to the rotor 131 by mounts 204, to transmit axial force to the pushing member 120. The rollers 202 are examples of an advancing screw structure that transmits axial force to the pushing member 120. The rollers 202 could be roller screws, ball screws, or lead screws. An upper mount 204A and a lower mount 204B each extend radially inward from the rotor 131 to provide attachment points for each end of a roller 202 to allow the roller 202 to rotate about an axis extending in the axial direction of the valve assembly 200. Each roller 202 has a generally cylindrical shape, with one or more threads or ridges 206 on an outer surface thereof to engage with the outer circumferential thread 126 of the pushing member 120. As the rotor 131 rotates, the rollers 202 roll around the outer surface of the pushing member 120, the ridges 206 engaging with the outer circumferential thread 126 to apply axial force to the pushing member 120.

In general, the apparatus described herein can be used for any well tool, above or below ground, with a component that moves in an axial direction of the drilling assembly, the production assembly, or the well. The component can be provided with a circumferential thread like the thread 126 on an outer circumferential wall or portion of the component. A rotor of the types described herein, or any other suitable type, has a structure, such as a thread or ridged roller, that can be engaged with the circumferential thread of the component to provide axial force on the component when the rotor rotates. A stator of the type described herein, disposed within a housing of the tool, can be electromagnetically coupled to the rotor to apply inductive force, upon application of electric power, to the rotor. Some examples of well or drilling-related applications include collet connectors where a collet is moved in the axial direction to engage a collet connection, and active drill pipe seals.

The preceding description has been presented with reference to present embodiments. Persons skilled in the art and technology to which this disclosure pertains will appreciate that alterations and changes in the described structures and methods of operation can be practiced without meaningfully departing from the principle, and scope of this present disclosure. Accordingly, the foregoing description should not be read as pertaining only to the precise structures described and shown in the accompanying drawings, but rather should be read as consistent with and as support for the following claims, which are to have their fullest and fairest scope.

The invention claimed is:

1. A blowout preventer, comprising:

a housing having an axial passage for flowing well fluid through the blowout preventer;

a component disposed within the housing around the axial passage, the component having a circular circumference and an outer wall with a circumferential thread on the outer wall of the component;

a gate assembly disposed within the housing and configured to open and close with axial movement of the component;

a rotor disposed within the housing and having a structure for engaging with the circumferential thread on the outer wall to provide axial force on the component when the rotor rotates;

a stator disposed within the housing and coupled to the rotor to rotate the rotor upon application of electric power;

a cap that engages with the housing at an end thereof, wherein the cap comprises a disk-like portion and an annular portion extending in an axial direction from the disk-like portion, wherein, when the cap is engaged with the housing, the disk-like portion contacts the gate assembly and the annular portion extends around a portion of the component, and wherein a distal end of the annular portion contacts the stator; and a power conduit coupled to the stator to apply electric power to rotate the rotor.

2. The blowout preventer of claim 1, wherein the rotor is a ring, and the structure for engaging with the circumferential thread of the outer wall of the component is an inner circumferential thread.

3. The blowout preventer of claim 1, wherein the stator is a continuous ring disposed around the rotor.

4. The blowout preventer of claim 1, wherein the housing has an inner wall and an outer wall that define an annular receptacle, and the component, the rotor, and the stator are disposed within the annular receptacle.

5. The blowout preventer of claim 4, further comprising a guide member disposed between the component and the inner wall of the housing.

6. The blowout preventer of claim 5, wherein the component has an inner radial extension that constrains axial motion of the component by contacting an end of the guide member.

7. The blowout preventer of claim 1, wherein the power conduit is disposed through an end wall of the housing.

8. The blowout preventer of claim 1, wherein the component is a pushing member.

9. A blowout preventer, comprising:

a housing having an axial passage for flowing well fluid through the blowout preventer, and the housing further having an inner wall and an outer wall that define an annular receptacle;

a component disposed within the housing around the axial passage, the component having a circular circumference and an outer wall with a circumferential thread on the outer wall of the component;

a guide member disposed between the component and the inner wall of the housing;

a gate assembly disposed within the housing and configured to open and close with axial movement of the component;

a rotor disposed within the housing and having a structure for engaging with the circumferential thread on the outer wall to provide axial force on the component when the rotor rotates;

a stator disposed within the housing and coupled to the rotor to rotate the rotor upon application of electric power; and a power conduit coupled to the stator to apply electric power to rotate the rotor, wherein the component, the rotor, and the stator are disposed within the annular receptacle.

10. The blowout preventer of claim 9, wherein the rotor is a ring, and the structure for engaging with the circumferential thread of the outer wall of the component is an inner circumferential thread.

11. The blowout preventer of claim 9, wherein the stator is a continuous ring disposed around the rotor.

12. The blowout preventer of claim 9, wherein the component has an inner radial extension that constrains axial motion of the component by contacting an end of the guide member.

13. The blowout preventer of claim 9, wherein the power conduit is disposed through an end wall of the housing.

14. The blowout preventer of claim 9, wherein the component is a pushing member.

15. The blowout preventer of claim 9, further comprising a cap that engages with the housing at an end thereof.

* * * * *